US006592156B2

(12) United States Patent
Levine

(10) Patent No.: US 6,592,156 B2
(45) Date of Patent: Jul. 15, 2003

(54) FRONT ADJUSTABLE CATCH

(76) Inventor: Steven Levine, 7 Plymouth Dr., Scarsdale, NY (US) 10583

( * ) Notice: Subject to any disclaimer, the term of this patent is extended or adjusted under 35 U.S.C. 154(b) by 0 days.

(21) Appl. No.: 09/942,274

(22) Filed: Aug. 29, 2001

(65) Prior Publication Data

US 2003/0042744 A1 Mar. 6, 2003

(51) Int. Cl.[7] ..... E05C 7/00

(52) U.S. Cl. ..... 292/23; 292/340; 292/341.11; 292/341.15; 292/341.17; 292/359; 292/DIG. 53; 49/420

(58) Field of Search ..... 242/9, 12, 15, 242/23, 341.11, 341.15, 341.17, 359, DIG. 53, DIG. 69; 49/417, 420

(56) References Cited

U.S. PATENT DOCUMENTS

| | | | | | |
|---|---|---|---|---|---|
| 203,302 | A | * | 5/1878 | Watkins | 292/15 |
| 294,560 | A | * | 3/1884 | Woodrich et al. | 70/86 |
| 587,131 | A | * | 7/1897 | Markert | 292/140 |
| 733,790 | A | * | 7/1903 | Young | 49/420 |
| 930,590 | A | * | 8/1909 | Beatty | 292/9 |
| 948,387 | A | * | 2/1910 | Ziganek | 70/110 |
| 973,285 | A | * | 10/1910 | Marsh | 49/420 |
| 1,008,463 | A | * | 11/1911 | Hart et al. | 292/21 |
| 1,027,874 | A | * | 5/1912 | Mason | 49/420 |
| 1,089,193 | A | * | 3/1914 | Ervien | 292/15 |
| 1,194,637 | A | * | 8/1916 | Joy | 292/341.11 |
| 1,287,606 | A | * | 12/1918 | allmand | 49/211 |
| 1,328,029 | A | * | 1/1920 | Anderson | 49/420 |
| 1,346,449 | A | * | 7/1920 | Gibson | 49/420 |
| 1,449,477 | A | * | 3/1923 | Wiley | 292/165 |
| 1,470,952 | A | * | 10/1923 | Baruch | 49/420 |
| 1,578,507 | A | * | 3/1926 | Ganahl | 49/417 |
| 1,720,636 | A | * | 7/1929 | Wread | 292/169.22 |
| 1,720,638 | A | * | 7/1929 | Wread | 292/169.22 |
| 1,720,639 | A | * | 7/1929 | Wread | 292/2 |
| 1,720,640 | A | * | 7/1929 | Wread | 292/337 |
| 1,733,108 | A | * | 10/1929 | Bienaime | 292/252 |
| 1,880,251 | A | * | 10/1932 | Hornung | 292/173 |
| 1,904,053 | A | * | 4/1933 | Katz | 292/172 |
| 1,940,084 | A | * | 12/1933 | Grasso | 292/60 |
| 1,979,826 | A | * | 11/1934 | Fernandez | 292/75 |
| 2,142,753 | A | * | 1/1939 | Hulcher | 16/83 |
| 2,184,879 | A | * | 12/1939 | Woernle | 292/75 |
| 2,315,337 | A | * | 3/1943 | Katz | 292/74 |
| 2,469,464 | A | * | 5/1949 | Gratkowski | 49/417 |
| 2,501,691 | A | * | 3/1950 | Ressa | 49/418 |
| 2,593,662 | A | * | 4/1952 | Dickinson | 292/252 |
| 2,729,417 | A | * | 1/1956 | Maynard | 410/111 |
| 2,878,049 | A | * | 3/1959 | Linton | 292/1 |
| 2,980,463 | A | * | 4/1961 | Russell et al. | 292/337 |
| 3,050,325 | A | * | 8/1962 | Zerwick | 292/218 |
| 3,102,708 | A | * | 9/1963 | Crain | 410/107 |
| 3,178,213 | A | * | 4/1965 | Nelson | 292/18 |
| 3,492,037 | A | * | 1/1970 | Hutchinson | 292/251.5 |
| 3,561,803 | A | * | 2/1971 | Schlage | 292/15 |
| 3,764,172 | A | * | 10/1973 | Standke | 292/15 |

(List continued on next page.)

FOREIGN PATENT DOCUMENTS

| | | | | | |
|---|---|---|---|---|---|
| DE | 1023698 | A | * | 1/1958 | 292/341.15 |
| GB | 237543 | A | * | 7/1925 | 292/15 |

*Primary Examiner*—William L. Miller
*Assistant Examiner*—Carlos Lugo
(74) *Attorney, Agent, or Firm*—Bodner & O'Rourke; Thomas A. O'Rourke

(57) ABSTRACT

An adjustable catch mechanism comprising a housing having one or more sidewalls and a face plate that includes an opening. A front plate adapted to be positioned over the face plate. The front plate is provided with an opening aligned with the opening of the face plate. An adjustable plate is positioned in the housing and has a base section that has a threaded portion adapted to receive a threaded member on a mounting frame. The mounting frame has a base with a top side and a bottom side wherein the bottom side has the threaded member and the top side has a catch member.

16 Claims, 6 Drawing Sheets

U.S. PATENT DOCUMENTS 3,999,788 A * 12/1976 Livingston ..... 292/1
4,169,620 A * 10/1979 Pacura ..... 292/347
4,227,726 A * 10/1980 Sorimachi ..... 292/251.5
4,230,352 A * 10/1980 Sealey et al. ..... 292/341.17
4,275,940 A * 6/1981 Draper ..... 312/209
4,343,500 A * 8/1982 Steiner ..... 292/175
4,462,623 A * 7/1984 Grant ..... 292/175
4,491,353 A * 1/1985 James ..... 292/75
4,497,152 A * 2/1985 Weissner ..... 52/709
4,601,502 A * 7/1986 Van Dyke ..... 292/252
5,593,194 A * 1/1997 Liau ..... 292/340
5,971,684 A * 10/1999 Wang ..... 410/107

* cited by examiner

FIG. 3
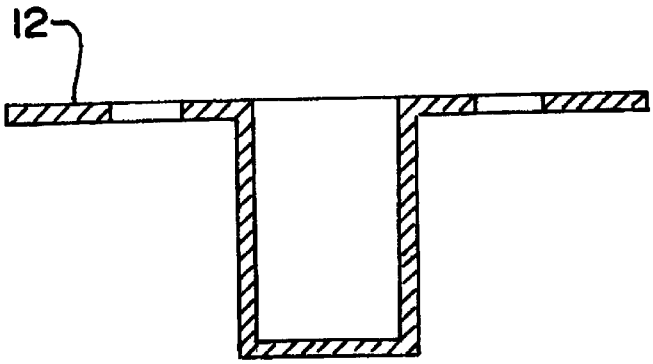
FIG. 4
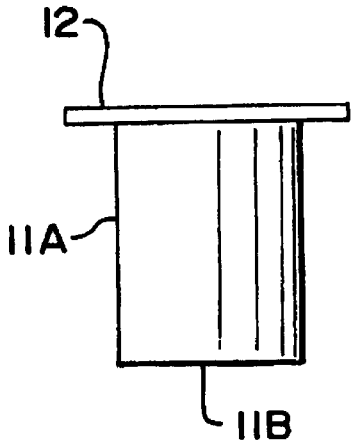
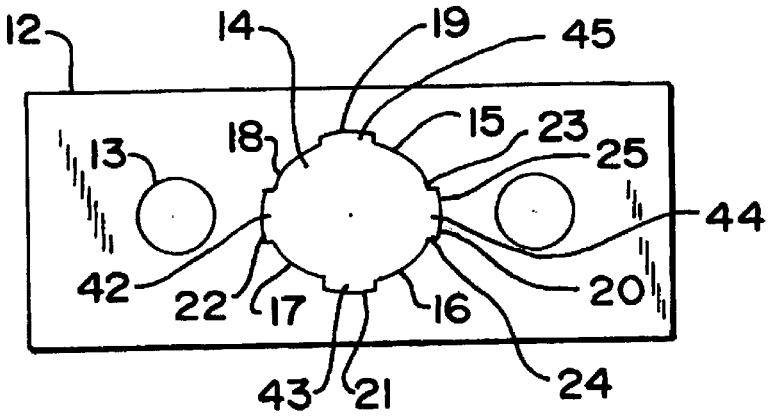
FIG. 5

FIG. 8
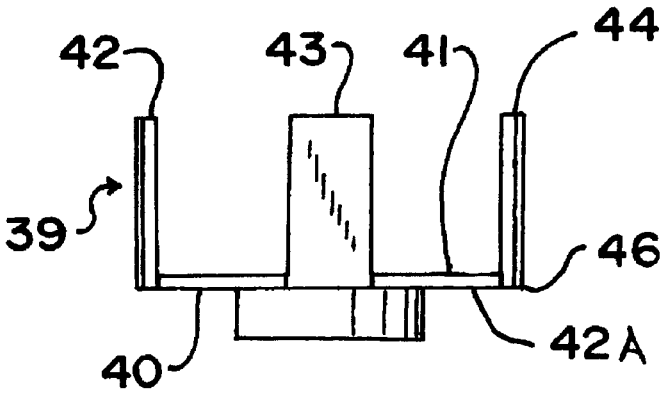
FIG. 9
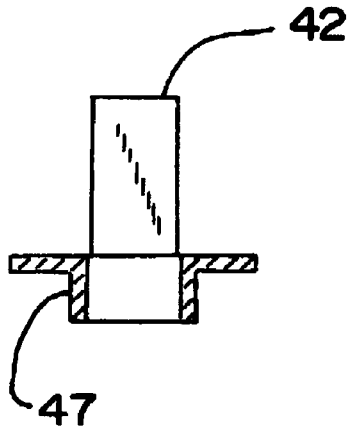
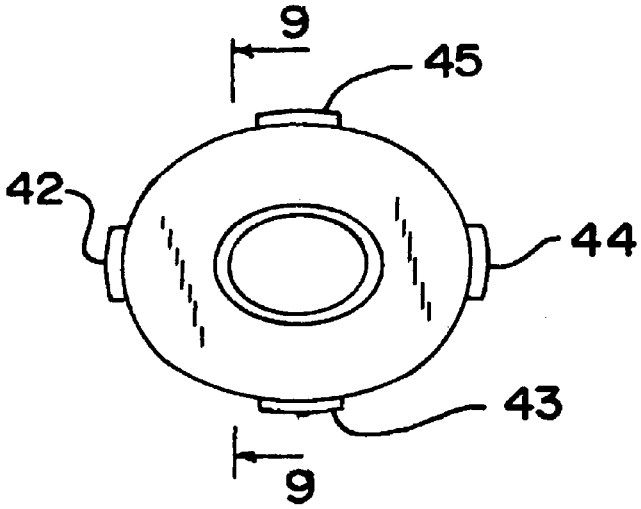
FIG. 10

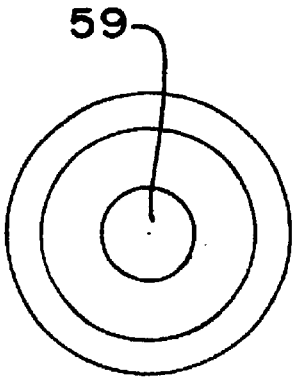
FIG. 15
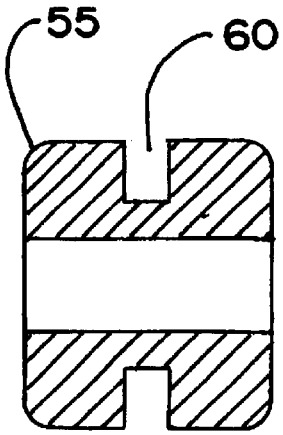
FIG. 16
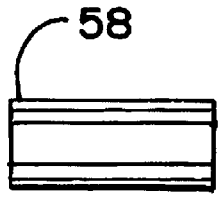
FIG. 17
FIG. 18
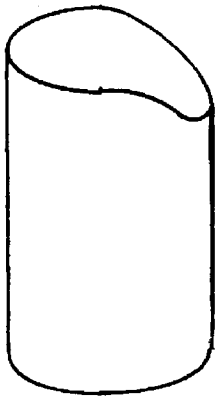
FIG. 19
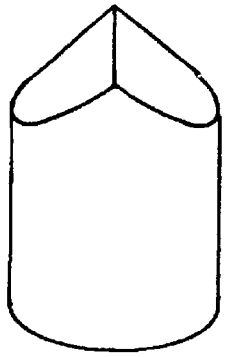
FIG. 20
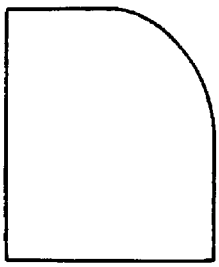
FIG. 21
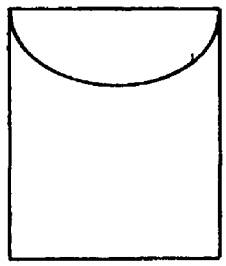

FRONT ADJUSTABLE CATCH

FIELD OF THE INVENTION

The present invention relates to the field of hardware, more particularly hardware having a catch, pin or a roller, etc. that is adjustable over a full range of heights.

BACKGROUND OF THE INVENTION

In many construction projects the cost of labor is one of the highest portions of many construction budgets. These high costs create great interest in the builder and the property owner in reducing labor expenses where possible. In attempting to reduce these costs, many construction managers look to use less skilled and therefore less expensive labor for some portions of a project. In addition, in many areas there is a shortage of skilled labor that causes the project leaders to resort to less skilled help. One downside to the use of less skilled labor is the added cost that is incurred due to the increase in errors made by these laborers. As a result, there is an interest in labor saving devices in many construction projects. In addition, there is an interest in labor saving devices that compensate for errors, deviations and variations incurred in the installation whether due to that workers, the workmanship of the construction materials or for other reasons.

One area where there can be great expenditure of time and effort in many projects is the installation of hardware. One type of such time and effort is in the installation of hanging doors, installing drawers and related items in cabinets closets and elsewhere. Many doors are still made of wood and when they are hung there is not always a uniform gap between the door and the frame. While there is a need for a gap to permit the door to swing open and shut properly without sticking, too large a gap can create problems with the installation of the door latch or catch, particularly many off the shelf door latches and door locking mechanisms. For example, the carpenter may have trimmed the door too much in installation or the opening made by the frame was not as wide as the plans originally called for. Also, in many renovations due to settling of the house over time or frames being out of plumb, a replacement door may have to be extensively trimmed to fit the door. If the carpenter is not careful too much can be taken off the door and unfortunately, wood cannot be added back. Where the gap has become too great between the frame and the door one of the problems that is encountered is the striker does not enter the frame and thus the door does not remain closed.

Mortising a latch or catch becomes particularly important today with many of the doors that are available. Solid construction for a door is becoming rarer and rarer in many projects due to its cost. As a result, there are more luan doors that have a thin solid perimeter frame around the door with a hollow core or a core that is not a wooden core but can be made of insulation. In these instances the more frame that is trimmed from the outside edge of the door increases the risk that the door latch will improperly extend into the hollow portion of the door or that the catch will not fit properly in the door. Even more traditional doors such as a colonial style, six panel door can have similar installation issues. Six panel doors have an outer frame that may be about 1.25 or 1.75 inches thick. Depending on the door, the frame to which the panels are attached is only several inches wide. Adjacent one side of the frame is the panel which is typically, very thin at its edges, i.e., in the area where the panel is inserted in or connected to the frame. While the panel normally increases in thickness toward the center of the panel, this is not useful to the installer when the catch is being installed in the door. There is frequently no room to correct the situation if the latch is mortised in the frame incorrectly or if the door is trimmed too aggressively. While the foregoing references wooden doors, many of these same issues can be incurred in connection with the installation of doors made of other materials such as steel and plastic doors and others.

Similar issues may also arise when cabinets are being made. In many instances, the frame of the cabinet is made separately from the drawers or the cabinet doors. In fact even in many custom cabinet projects for a kitchen or elsewhere, the doors and drawer faces are made first or specially ordered and the cabinets are built around the selected drawer front and the doors. Nevertheless, due to variations in the wood used, the skill of the cabinet maker, the humidity in the workshop or in the kitchen, all create variables that can cause there to be different gaps between the door or drawer and the frame of the cabinet. As a result, there can be issues with the fit of the drawer and door hardware due to these variations.

In addition, to doors and cabinets, there are a number of other instances where an adjustable catch or latch is necessary, to alleviate problems with the fit and finish of the article. As a result, there is a need for a full range adjustable latch or catch that may be used in a variety of applications where forgiveness of errors in installation or variations in materials is necessary.

OBJECTS OF THE INVENTION

It is an object of the invention to provide an improved latch or catch that may be used in a number of applications.

It is an object of the invention to provide an adjustable catch or latch that will alleviate errors including errors made during installation or manufacturing.

It is also an object of the invention to provide an adjustable catch or latch that will alleviate defects or inconsistencies in materials that the catch being installed in.

It is another object of the invention to provide an improved catch or latch that is adjustable over a full range.

It is another object of the invention to provide an improved adjustable catch or latch that may be provided with a roller, a pin, a striker, etc.

It is another object of the invention to provide an adjustable catch or latch that is has superior strength for use in a variety of applications where high stresses are present.

It is still another object of the invention to provide a catch, latch, stopper or keeper that is easy to use and install in a variety of applications.

SUMMARY OF THE INVENTION

The present invention is directed to an improved catch or latch for a variety of applications including but not limited to doors, drawers, etc. Some other applications include refrigerator doors, oven door, freezer doors and others. The catch of the present invention may also be used as a door stop to fit in the a door which will catch a stop mounted nearby. The apparatus may also be used on windows where the device is mounted on each side of sash and locks into notches in frame to retain the window in a given partially open position.

The catch is generally adjustable over a full range to compensate for difficulties, including difficulties in manufacture and in installation, applications where there are alignment problems and others. The catch is front adjustable so that even after installation adjustments may be made without having to remove the catch. The catch may be adjusted by means of a screwdriver or other thin narrow blade or other type of tool into, for example, a slot in a roller or striker or a pin. The catch means which may include for example a roller a pin or a striker is then depressed and turned either clockwise or counter clockwise to adjust the distance the catch means extends from the housing. The turning of the catch means allows the lower threaded section of the mounting frame thread into or out of the adjusting plate, thus raising or lowering the catch means.

The catch means is designed to preferably move inwardly or retract when the means such as a striker or roller is struck by the adjacent frame, such as a door frame or other object. An internal spring permits inward and outward movement of the catch means assembly When the inward or outward motion of the roller is completed a spring or springs force the catch means back out into the raised position. The front plate holds the catch means assembly in place. One or more tracks and one or more plate guides prevent the adjusting plate from rotating as the catch means is turned in the raising and lowering thereof.

BRIEF DESCRIPTION OF THE DRAWINGS

FIG. 3 is a side view of the housing of the catch of the present invention.

FIG. 4 is an end view of the housing of FIG. 3.

FIG. 5 is a top view of the housing of FIG. 3.

FIG. 8 is a side view of the adjusting plate of the catch of the present invention.

FIG. 9 is an end view of the adjusting plate of FIG. 8.

FIG. 10 is a top view of the adjusting plate of FIG. 8.

FIG. 15 is a top view of the roller of the catch of the present invention.

FIG. 16 is a side cut away view of the roller of FIG. 15.

FIG. 17 is a side view of the pin for the roller of FIG. 16.

FIG. 18 shows a flat cylinder strike.

FIG. 19 shows a pin strike.

FIG. 20 shows a side view of a strike.

FIG. 21 shows a front view of the strike of FIG. 20.

DETAILED DESCRIPTION OF THE DRAWINGS

Figure 2:
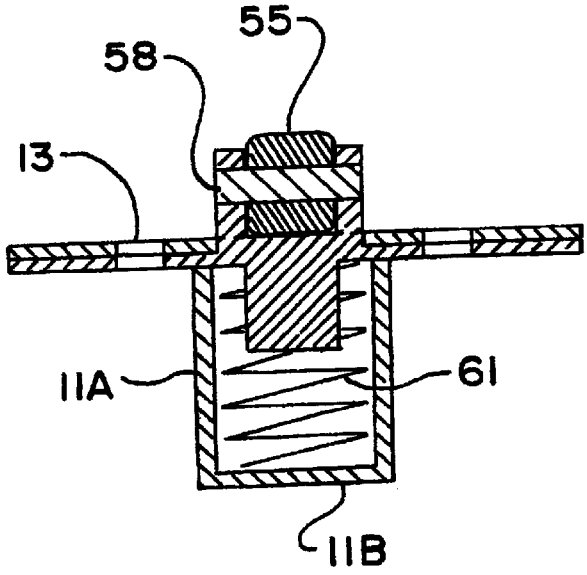
FIG. 2 is a cut away side view of the catch of FIG. 1.
Figure 1:
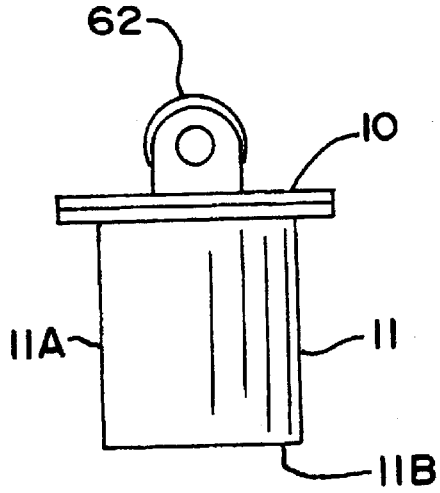
FIG. 1 is a side view of the housing of the catch of the present invention.
Figure 6:
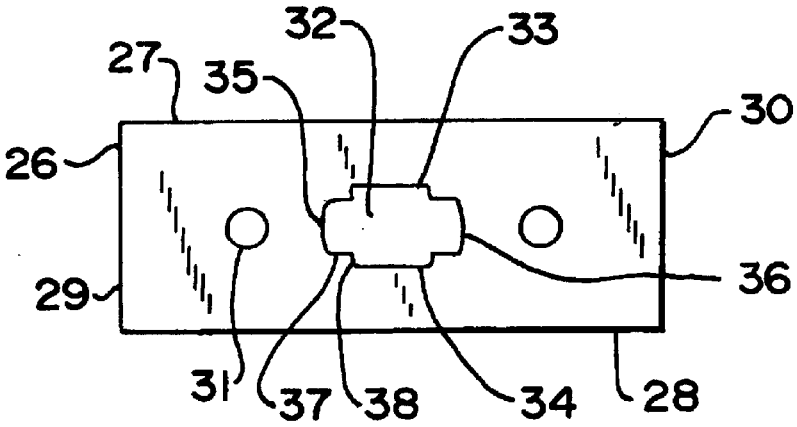
FIG. 6 is a top view of the front plate of the catch of the present invention.
Figure 7:
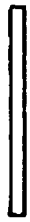
FIG. 7 is a side view of the front plate of FIG. 6.
Figure 14:
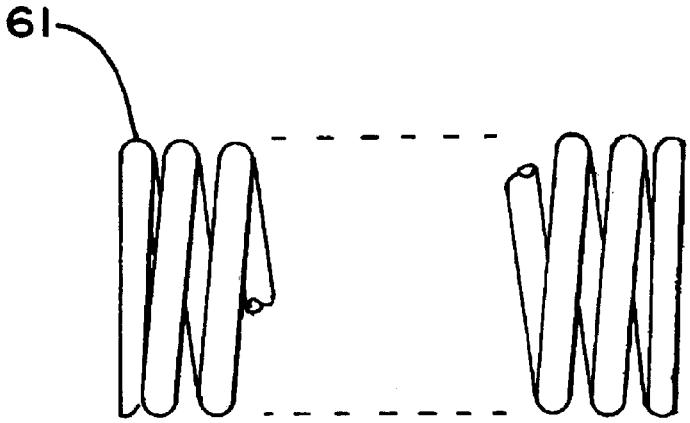
FIG. 14 is a side view of the spring of the catch of the present invention.

The present invention is directed to a catch 10 that has a housing 11. The housing 11 has one or more side walls 11A and a base portion 11B. As seen in FIGS. 1 and 2 the base portion holds the base of the spring in position. The base portion may be cover the entire area between the side walls or at least a portion thereof. The housing may be any shape desired. However, the sidewall of the housing are preferably round and form a circle so that an opening may be drilled in the article to which the housing is installed. The article may include but is not limited to a door, a drawer a wall surface, a frame surface or any other item that needs to be secured or be provided with a catch. If the housing is not round it may be more difficult to form the hole that the housing is inserted into as that hole will have to be specially mortised usually by hand using for example a chisel.

The housing preferably has a face plate 12 that one or more holes 13 for securing the housing to the article. There is an opening 14 in the face plate 12 which permits the catch mechanism to be inserted into the housing 11. In one embodiment the face plate has four curved sections 15, 16, 17 and 18 that are separated by four recesses 19, 20, 21 and 22. The recesses preferably have a pair of side walls 23 and 24 that are joined by base wall 25. Placed over the face plate 12 is a separate front plate 26. The front plate retains at least a portion of the catch mechanism within the housing 11. The front plate 26 may be a generally rectangular flat plate having a pair of side walls 27 and 28 that are joined by end walls 29 and 30. The front plate is provided with one or more holes 31 that may be aligned with the holes in the face plate 12. In one embodiment, the front plate is also provided with an opening 32 that is generally aligned with the opening 14 in the face plate 12. The front plate's opening is shaped so that the catch means 62 can retractably pass through the opening. For example, in one embodiment, the front plate opening 32 preferably has first and second linear sections 33 and 34 that are generally aligned parallel to side walls 27 and 28 and two curved sections 35 and 36 that are generally aligned parallel to end walls 29 and 30. Curved sections 35 and 36 are joined to linear sections 33 and 34 by legs 37 and 38. Although the linear sections 33 and 34 are shown generally parallel to the side walls, it will be appreciated by those skilled in the art that the linear sections may be generally parallel to the end walls 29 and 30, and the curved sections may be aligned with the sidewalls 27 and 28. The opening in the front plate can vary depending on the shape of the catch mechanism. The shape shown is for situations where the catch mechanism is a roller.

Positioned within the housing 11 is an adjustable plate 39. The adjustable plate 39 has a base section 40 that is generally flat with a top surface 41 and bottom surface 42A. Extending upwardly from the top section are one or more prongs 42, 43, 44, and 45. These prongs are arranged so that they mate with the recesses 19, 20, 21 and 22 in the face plate. The recesses prevent the adjustable plate from turning when adjusting of the catch occurs. While the Figures show that there are four recesses in the face plate and four prongs in the adjustable plate it will be appreciated that the invention is not limited to four and one or more may accomplish the same result of preventing the adjustable plate from rotating. In addition, other means may be employed to prevent rotation such as a pin extending from the sidewall 46 of the adjustable plate 39 into an orifice in the housing 11. Alternatively, the housing 11 may be provided with one or more ribs that extend into a recess in the adjustable plate to prevent rotation.

Figure 11:
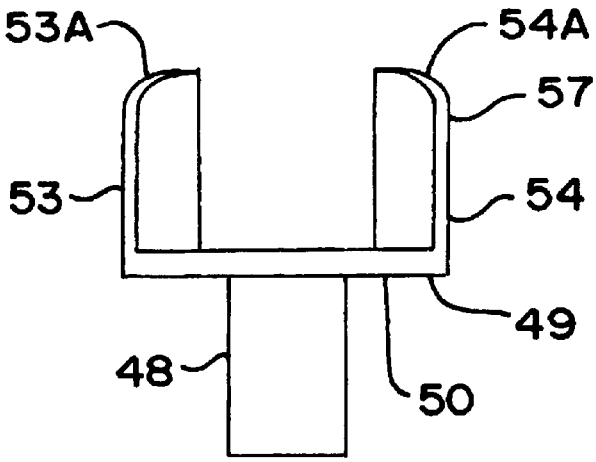
FIG. 11 is a side view of the mounting frame of the present invention.
Figure 12:
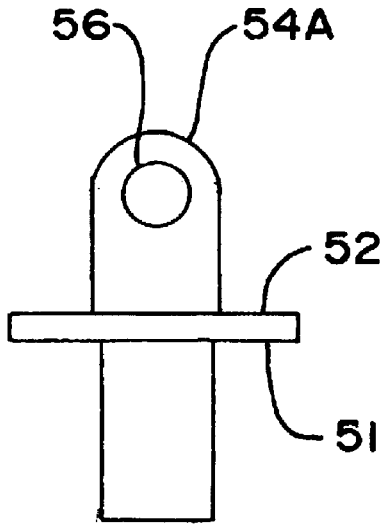
FIG. 12 is a side view of the mounting frame of FIG. 11 rotated 180 degrees.
Figure 13:
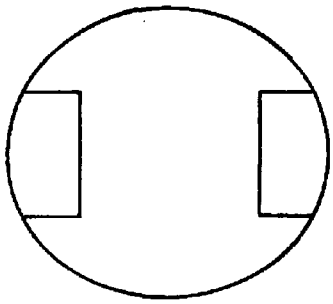
FIG. 13 is a top view of the mounting frame of FIG. 11.

Extending from the bottom surface 42A of the adjustable plate 39 is a orifice 47 having a threaded portion on the inside of the orifice that receives a threaded member 48 on the mounting frame 49. The mounting frame 49 has a base 50. The underside 51 of the base 50 has the threaded member 48 extending therefrom. The top side 52 of the mounting frame 49 has catch means 62. In one embodiment that catch means 62 may have a pair of posts 53 and 54 that support a roller 55. The posts 53 and 54 are provided with orifices 56 and 57 that receive pin 58 that acts as the axle of the roller 55 and passes through the center 59 of the roller. Posts 53 and 54 are preferably rounded as depicted in FIGS. 11 and 12 to prevent the roller assembly from sticking on the front plate when the mounting frame is raised by the spring. As seen in FIG. 11 there may be a first radius 53A on each post and a second radius 54A also on each post. The roller is also preferably provided with a slot 60 that permits a screw driver or other device to push the roller downwardly. In an alternative embodiment the catch means may be a striker extending from the top side 52 of the mounting frame may replace the roller. The striker may also be provided with a similar slot or other shape for causing the striker to be pushed downwardly. In another embodiment, instead of a roller or a striker the catch means can also be a pin that extends from the mounting frame that is received by an orifice that the catch is to secure. Spring 61 supports the adjustable plate 39. FIGS. 18–21 show examples of strikes that can also be used with the present invention.

In operation, the height of the catch means may be adjusted by pushing down on the catch means. This causes the adjusting plate to similarly force down the spring. The catch means can then be turned either clockwise or counter clockwise causing the threaded member to recess further into the threaded portion or extend further depending on whether the catch means is to be extended or recessed. Depending on the shape of the catch means 62 and the opening 32 in front plate 26, the amount the catch means is turned will determine the amount the catch means is either extended or recessed. Where the catch means is a pin for example, the range of extension or recession of the pin may vary over a full range as the pin may be turned only a slight distance significant amounts. Where the catch means is a roller, the roller will typically be adjusted in increments of one-half revolution, i.e., 180 degrees of rotation as the alignment of the roller should end up the same as when it started. When the catch means is a striker, the adjustment increment will typically be a full revolution.

I claim:

1. An adjustable mechanism comprising a housing, said housing having one or more side walls and a face plate, said face plate having an opening therein, such that said opening communicates with an interior portion of said housing;

a front plate adapted to be positioned over said face plate, said front plate being provided with an opening that is generally aligned with the opening in the face plate and shaped so that a catch means can retractably pass through said opening and an adjustable plate positioned in said housing said adjustable plate having a base section with a top surface and a bottom surface, said adjustable plate being prevented from undergoing rotational movement in said housing, said base section having a threaded portion that is adapted to receive a threaded member on a mounting frame said mounting frame having a base with a top side and a bottom side and wherein the bottom side of the base has the threaded member extending therefrom into said threaded portion of said adjustable plate and wherein the top side of the mounting frame has said catch means and wherein the height of said catch means may be adjusted incrementally when the catch means is pushed into said housing and rotated thus causing the threaded member to recess or extend in the threaded portion to thereby incrementally change the height of the catch means.

2. The mechanism according to claim 1 wherein the housing is round.

3. The mechanism according to claim 1 wherein the face plate has one or more curved sections that are separated by one or more recesses.

4. The mechanism according to claim 3 wherein said recesses have a pair of side walls that are joined by a base section.

5. The mechanism according to claim 4 wherein said front plate retains at least a portion of the catch means within the housing.

6. The mechanism according to claim 5 wherein the front plate is a generally rectangular flat plate having a pair of side walls that are joined by end walls, said front plate being provided with one or more holes that may be aligned with holes in the face plate.

7. The mechanism according to claim 6 wherein the front plate opening has first and second linear sections that are generally aligned parallel to said side walls and two curved sections that are generally aligned with said end walls.

8. The mechanism according to claim 7 wherein said curved sections have a first end and a second end and said linear sections have a first end and a second end and where the ends of the curved sections are each joined to said linear sections at their respective ends by first and second legs.

9. The mechanism according to claim 1 wherein said housing has a base portion at least a portion of which extends between said side walls.

10. An adjustable mechanism comprising a housing, said housing having one or more side walls and a face plate, said face plate having an opening therein, such that said opening communicates with an interior portion of said housing;

a front plate adapted to be positioned over said face plate, said front plate being provided with an opening that is generally aligned with the opening in the face plate and shaped so that a catch means can retractably pass through said opening and an adjustable plate positioned in said housing said adjustable plate having a base section with a top surface and a bottom surface, said adjustable plate being prevented from undergoing rotational movement in said housing, said base section having a threaded portion that is adapted to receive a threaded member on a mounting frame, said adjustable plate having one or more prongs extending upwardly from said top surface that mate with corresponding recesses in the face plate;

said mounting frame having a base with a top side and a bottom side and wherein the bottom side of the base has the threaded member extending therefrom into said threaded portion of said adjustable plate and wherein the top side of the mounting frame has said catch means and wherein the height of said catch means may be adjusted when the catch means is pushed into said housing and rotated thus causing the threaded member to change the height of the catch means.

11. The mechanism according to claim 10 wherein the catch means is a roller.

12. The mechanism according to claim 10 wherein the catch means is a striker.

13. The mechanism according to claim 10 wherein the catch means is a pin.

14. The mechanism according to claim 11 wherein the top side of said base section has a pair of posts that support a roller said posts being provided with orifices for receiving an axle of the roller that passes through said roller.

15. The mechanism according to claim 10 wherein said catch means is provided with a slot that permits a screw driver or other device to push the catch means downwardly into said housing.

16. An adjustable mechanism comprising a housing, said housing having one or more side walls and a face plate, said face plate having an opening therein, such that said opening communicates with an interior portion of said housing;

a front plate adapted to be positioned over said face plate, said front plate being provided with an opening that is generally aligned with the opening in the face plate and shaped so that a catch means can retractably pass through said opening, said front plate retaining at least a portion of the catch means within the housing, said face plate having one or more curved sections that are separated by one or more recesses, said recesses having a pair of side walls that are joined by a base section, and wherein the front plate is a generally rectangular flat plate having a pair of side walls that are joined by end walls, said front plate being provided with one or more holes that may be aligned with holes in the face plate, the front plate opening having first and second linear sections that are generally aligned parallel to said side walls and two curved sections that are generally aligned with said end walls, said curved sections having a first end and a second end and said linear sections have a first end and a second end and where the ends of the curved sections are each joined to said linear sections at their respective ends by first and second legs, and an adjustable plate positioned in said housing said adjustable plate having a base section with a top surface and a bottom surface, said adjustable plate being prevented from undergoing rotational movement in said housing, said base section having a threaded portion that is adapted to receive a threaded member on a mounting frame, said adjustable plate having one or more prongs extending upwardly from said top surface that mate with corresponding recesses in the face plate, said adjustable plate having one or more prongs extending upwardly from said top surface that mate with corresponding recesses in the face plate;

said mounting frame having a base with a top side and a bottom side and wherein the bottom side of the base has the threaded member extending therefrom into said threaded portion of said adjustable plate and wherein the top side of the mounting frame has said catch means and wherein the height of said catch means may be adjusted when the catch means is pushed into said housing and rotated thus causing the threaded member to change the height of the catch means.

* * * * *